United States Patent [19]

Blau

[11] Patent Number: 5,072,849

[45] Date of Patent: Dec. 17, 1991

[54] CONTAINER AND SUBSTANCE TESTING METHOD

[75] Inventor: Robert A. Blau, Golden Valley, Minn.

[73] Assignee: R. Alan Blau & Associates, Inc., Minneapolis, Minn.

[21] Appl. No.: 574,651

[22] Filed: Aug. 29, 1990

[51] Int. Cl.[5] ..... B65D 51/18

[52] U.S. Cl. ..... 220/253; 220/711; 222/555; 239/59

[58] Field of Search ..... 220/253, 336, 90.2, 220/90.4; 222/480, 548, 555; 239/58, 59

[56] References Cited

U.S. PATENT DOCUMENTS

| | | | |
|---|---|---|---|
| 923,895 | 6/1909 | Ryburg et al. | 220/336 |
| 1,501,209 | 7/1924 | Flagg | 222/480 |
| 3,126,125 | 3/1964 | Eggers | 222/555 X |
| 3,402,847 | 9/1968 | Bridenstine | 220/253 |
| 4,190,173 | 2/1980 | Mason et al. | 220/203 |
| 4,346,823 | 8/1982 | Eppenbach | 222/443 |
| 4,437,576 | 3/1984 | Barniak | 220/90.4 |
| 4,579,245 | 4/1986 | Narushko | 220/253 |
| 4,643,881 | 2/1987 | Alexander et al. | 422/265 |

*Primary Examiner*—Gary E. Elkins
*Assistant Examiner*—Stephen Cronin
*Attorney, Agent, or Firm*—Merchant, Gould, Smith, Edell, Welter & Schmidt

[57] ABSTRACT

A container including a housing and a cover assembly including first and second lids pivotally interconnected by a rivet assembly. A gasket being disposed between the first and second lids. The first and second lids and the gasket having openings alignable with one another so as to enable movement of the second lid relative to the first lid, thereby providing an opening from an interior of the container to an exterior of the container.

9 Claims, 2 Drawing Sheets

CONTAINER AND SUBSTANCE TESTING METHOD

TECHNICAL FIELD OF THE INVENTION

The present invention relates to a container and substance testing method which readily lends itself to testing a plurality of substances including liquids, vapors and solids including but not limited to fragrances, aromas and flavors which are subject to sensing via the olfactory and/or taste sensing systems and capabilities, and/or skin surfaces, and/or surfaces of the mouth, nose and eyes.

BACKGROUND OF THE INVENTION

Testing of substances such as fragrances, aromas, flavors, etc. is commonly done and is very important to many businesses. For example, manufacturers and marketers of a vast range of products that use fragrances, such as perfumes, drugs, pharmaceuticals, cosmetics, health and beauty aids, household products, cleaners, soaps, detergents, laundry products, etc. are very concerned with fragrance testing. Fragrances are an important product feature and a major factor in consumer perception of product quality, efficacy and overall satisfaction. In addition to deriving an initial product fragrance, product fragrances often need to be changed every few years. The optimum choice of a fragrance can give a manufacturer of a product an important competitive advantage in the market place.

In order to derive a suitable fragrance for the product, it is often necessary to test a number of alternative product fragrances. Fragrance testing requires the effective testing of a number of fragrances under tightly controlled scientific conditions. Typically, this is done in very expensive and time-consuming laboratory facilities that are located in a company's own product research center, since fragrance testing away from the company's own facilities ordinarily lack suitable control. Once any fragrance is exposed for testing, it readily contaminates the overall area, making it impractical to obtain unbiased responses to any other fragrances that might be tested at the same location.

The present invention provides a novel container and a substance testing method which solves these and other problems associated with testing substances including liquids, vapors and solids including but not limited to fragrances, aromas, flavors, etc.

SUMMARY OF THE INVENTION

The present invention relates to an inexpensive container having a cover assembly which allows ready access to an interior of the container without removal of the cover assembly and which readily encloses the container to provide a fluid impermeable container.

The present invention relates to a substance testing method which readily lends itself to testing a plurality of substances including liquids, vapors and solids including but not limited to fragrances, aromas and flavors which are subject to sensing via the olfactory and/or taste sensing systems and capabilities, and/or skin surfaces, and/or surfaces of the mouth, nose and eyes.

One embodiment of the present invention pertains to a relatively inexpensive method for testing a plurality of fragrances at a single location.

In one embodiment of the present invention, the container includes a cover assembly and a housing. The cover assembly includes two fluid impermeable lids separated by a gasket material and pivotally interconnected for rotation relative to each other. The housing includes fluid impermeable walls, and cooperates with the cover assembly to form a substantially enclosed fluid impermeable container. The first and second lids and the gasket each include at least one aperture capable of axial alignment with each other upon rotation of the first and second lids relative to one another so as to provide an outlet from the container, whereby fluid such as fragrance fumes can escape from an interior of the container.

One embodiment of the present invention also relates to a method for testing fragrances comprising the steps of placing fragrance samples into a substantially fluid impermeable container and moving a second lid of the container relative to a first lid of the container so as to provide an outlet of the fragrances from the container.

In yet another embodiment of the present invention, the container system includes a substantially impermeable styrofoam cup including two plastic lids superimposed on each other with a gasket material disposed between the two lids. The lids are riveted together in a pivotal fashion proximate the center thereof with the gasket disposed between the two lids. Each of the lids and the gasket has an opening so as to enable alignment of the openings upon rotation of the second lid, thereby permitting formation of an opening out of the interior of the container.

In one preferred embodiment, the gasket is made of a felt material. In yet another preferred embodiment, the openings cut in the two lids and the gasket are cut from proximate the center of the lids to an edge of the lids in a widening pattern.

The container of the present invention has numerous applications other than for use in substance testing, one example being a drinking container.

These and other advantages and features of novelty which characterize the invention and are pointed out with particularity in the claims annexed hereto and forming a part hereof. However, for a better understanding of the invention, its advantages, and the objects obtained by its use, reference should be made to the accompanying drawings and descriptive matter, which form a further part hereof, and in which there is illustrated and described a preferred embodiment of the invention.

BRIEF DESCRIPTION OF THE DRAWINGS

In the drawings wherein like reference numerals indicate corresponding parts throughout the several views.

DETAILED DESCRIPTION OF A PREFERRED EMBODIMENT OF THE PRESENT INVENTION

Figure 1:
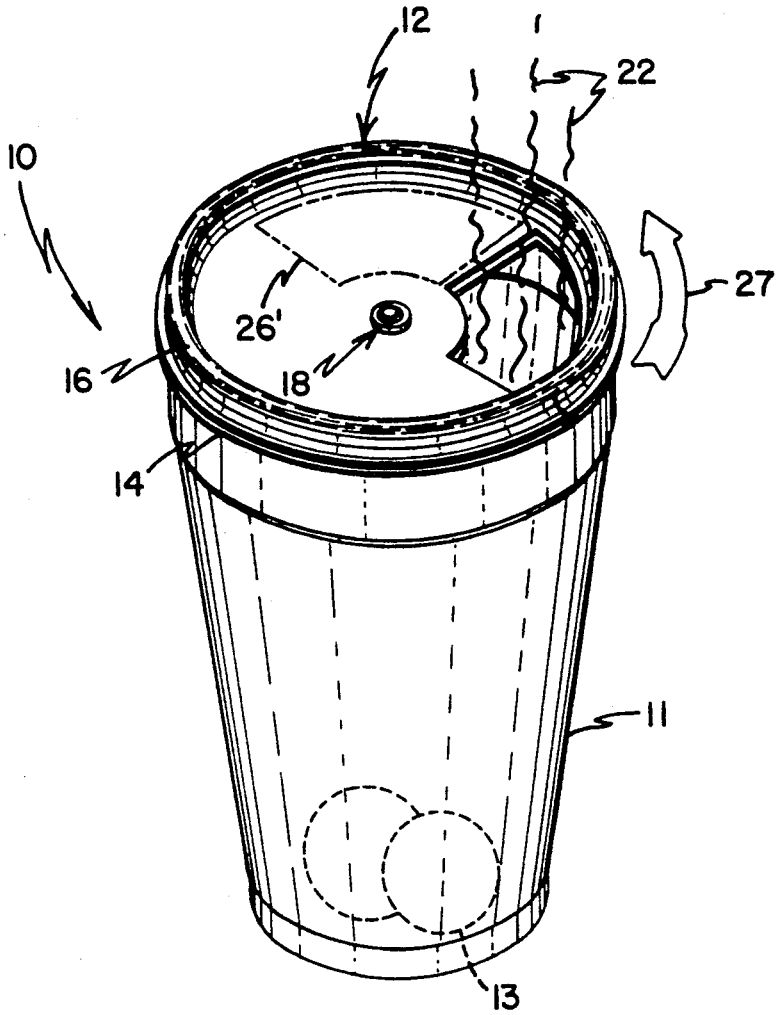
FIG. 1 is a perspective view of an embodiment of a container in accordance with the principles of the present invention.

Referring now to the drawings, there is illustrated in FIG. 1 a preferred embodiment of a container in accordance with the principles of the present invention, the container being generally referred to by the reference numeral 10. For purposes of illustration the container is described as being used with fragrance testing although it should be appreciated that the container has numerous other applications.

As shown, the container 10 includes a styrofoam housing 11 having fluid impermeable walls and a fluid impermeable cover assembly 12. The cover assembly 12 includes first and second plastic lids 14, 16 superimposed on each other with a felt material gasket 20 disposed therebetween. The first and second lids 14, 16 are pivotally riveted together proximate center by a rivet assembly 18. In the preferred embodiment shown, the gasket 20 is attached to the second lid 16 by an adhesive 21, thereby enabling movement of the gasket 20 with the second lid 16. It will be appreciated that the housing 11 and the lids 14,16 can be made of various impermeable materials including but not limited to styrofoam, plastic, paper or other suitable impermeable material. Moreover, the gasket may also be made of material other than felt.

Figure 2:
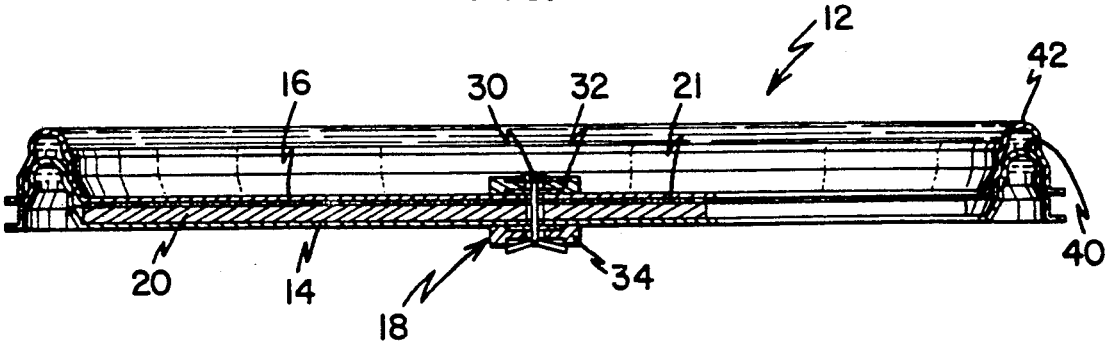
FIG. 2 is a partial, enlarged, cross sectional view of a cover assembly of the container shown in FIG. 1.
Figure 3:
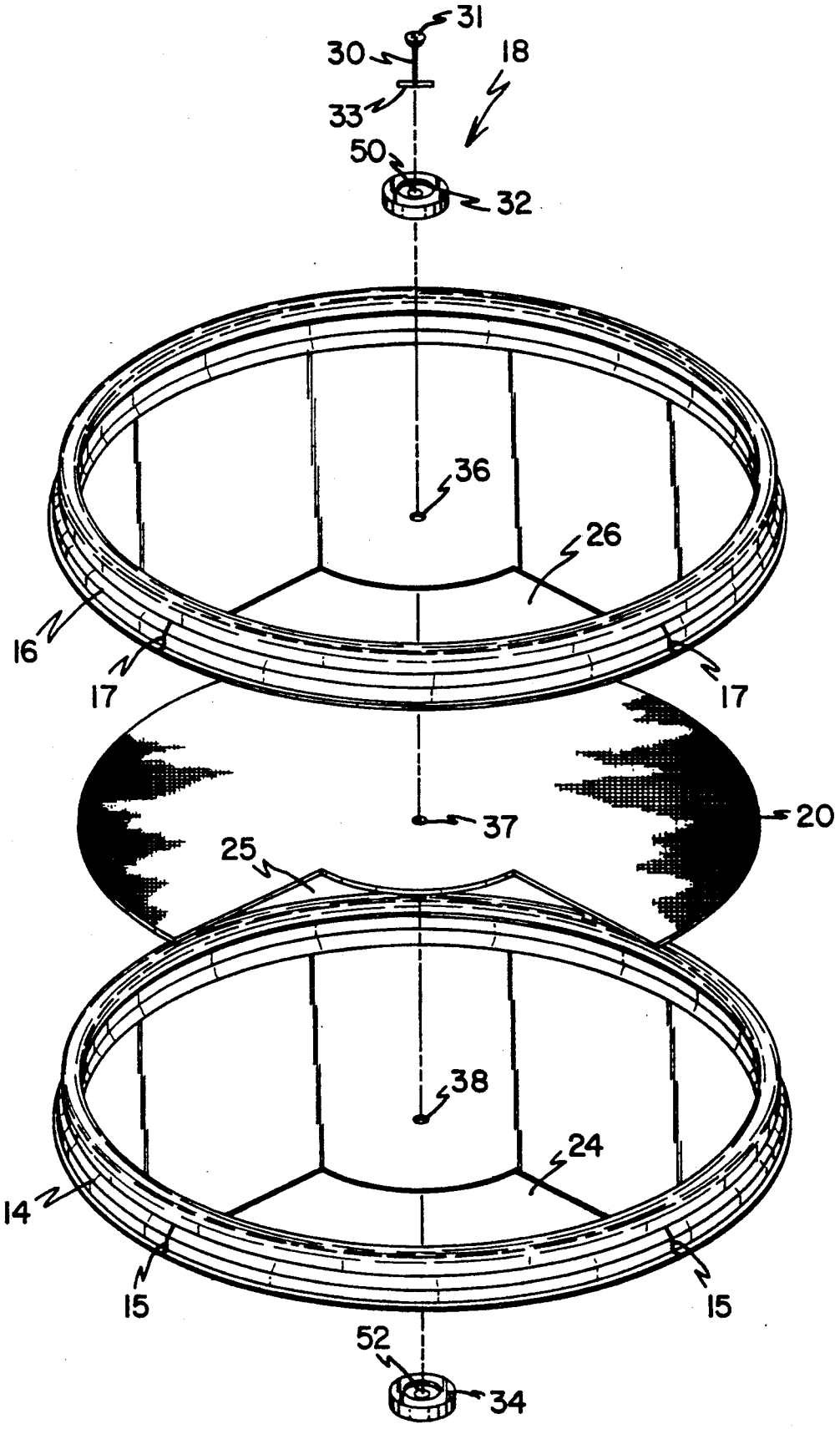
FIG. 3 is an enlarged, exploded view of the cover assembly shown in FIG. 2.

As more particularly illustrated in FIGS. 2 and 3, the first and second lids 14, 16 and the gasket 20 each have an opening 24, 26, 25, respectively, cut from proximate their center to their edge in a widening pattern, such that when aligned, the openings 24, 25 and 26 provide an opening into and out of an interior of the container 10.

As illustrated in FIG. 1, the first and second lids 14, 16 are pivotable relative to one another so as to enable opening or closing of the container 10, as desired. As illustrated best in FIG. 2, the first and second lids 14, 16 include raised edge portions 40 and 42, respectively, cooperating with each other to enable relative pivotal movement of the first and second lids 14, 16. Additionally, the raised portion 40 of the first lid 14, is removably received on an upper edge of the housing 11 thereby enabling removal of the cover assembly 12 so as to allow access to an interior of the container 10 for insertion of liquids, vapors, or solids into the container 10; for example, for insertion of cotton balls 13 or the like containing a fragrance thereon. In a preferred embodiment, the raised edge portion 40 of the first lid 14 sufficiently engages an upper edge of the housing 11 to cause the first lid 14 to remain stationary while the second lid 16 is rotated as generally indicated by an arrow 27 in FIG. 1 so as to close the opening in the container 10 by positioning the opening 26 out of alignment with the opening 24 as illustrated by phantom line 26' in FIG. 1.

Illustrated in FIG. 3 is an embodiment of the rivet assembly 18. In the embodiment shown, the rivet assembly 18 includes two buttons 32 and 34 on opposite facing surfaces of the cover assembly 12. Aligned holes 36, 37 and 38 are provided in the cover 16, the gasket 20 and the cover 14, respectively. The buttons 32 and 34 similarly include holes 50 and 52, respectively. A flexible resilient fastener 30 including a head portion 31 and an anchor portion 33 is folded and inserted through the holes 36, 37, 38 in the cover assembly 12 and the holes 50, 52 in the buttons 32, 34. Once inserted, the fastener 30 holds the cover assembly 12 together. The first and second lids 14, 16 might include alignment indicia 15, 17, respectively, to indicate when the openings are aligned.

It will be appreciated, that the container may take on varying features and embodiments and yet be in keeping with the principles of the present invention. For example, the container 10 might be made of differing materials and might have differing configurations. In addition the openings 24, 25, 26 in the cover assembly 12 might also have varying configurations and might incorporate a plurality of openings.

The present invention also pertains to a method of testing a plurality of substances including liquids, vapors and solids including but not limited to fragrances, aromas and flavors, etc. The method will be described in terms of testing fragrances. In one embodiment of the fragrance testing method, the cotton balls 13, or other suitable fragrance bearing media, would be inserted into the container 10. Once inserted, the cover assembly 12 of the container 10 would be placed over the housing 11 and the openings 26 and 24 pivoted out of alignment so as to provide a substantially fluid impermeable container containing the cotton balls and their associated fragrance(s). It will be appreciated that a composition or combination of fragrances might be put on the cotton balls 13. Moreover, fragrance bearing media other than cotton balls might be used and/or the fragrance might simply be placed in the housing without any specific media.

The container would then be given to a tester who would pivot the second lid 16 relative to the first lid 14 such that the openings 24, 25, 26 were in alignment so as to allow exit of the fragrance fumes 22. The user would take a brief sniff of the fragrance fumes 22 and then pivot the second lid 16 back to the closed position such that the opening from the container was sealed off. The tester would test a plurality of fragrances in this fashion and record his/her test results.

It will be appreciated that this method of testing will limit the exposure of the fragrance to the room or test location such that very little, if any, of the fragrance will escape into the test location. Accordingly, the testers can evaluate a variety of different fragrances without the inaccuracies created by fragrances contaminating the test area.

In the preferred embodiment, the container is very inexpensive and is disposable. Accordingly, after using a container for testing a single fragrance, the container and its cotton balls can be disposed of so as to ensure no contamination with additional fragrances to be tested.

Although the container of the present invention is disclosed as having application for substance testing it will be appreciated that the container has numerous other uses.

Moreover, having read the foregoing description, it is to be understood, that even though numerous characteristics and advantages of an embodiment of the present invention in accordance with the principles of the invention has been set forth in the foregoing description, the disclosure is illustrative only, and changes may be made in detail, especially in matters of shape, size and arrangement of the parts within the principles of the invention to the full extent indicated by the broad general meaning of the terms in which the appended claims are expressed.

What is claimed is:

1. A container comprising:

a housing having substantially fluid impermeable walls; and a cover assembly including first and second substantially identical fluid impermeable lids pivotally interconnected proximate their center for pivotal movement relative to one another, the cover assembly further including a gasket disposed between the first and second lids, the first and second lids and the gasket cooperating with each other to provide a substantially fluid impermeable container, the first and second lids and the gasket including openings alignable with each other to provide an opening into an interior of the container upon rotation of the first and second lids relative to one another.

2. A container in accordance with claim 1, wherein the housing includes a styrofoam cup.

3. A container in accordance with claim 1, wherein the first and second lids are made of plastic.

4. A container in accordance with claim 1, wherein the gasket is adhesively attached to the second lid.

5. A container in accordance with claim 1, wherein the openings of the first and second lids are cut from proximate a center of the first and second lids to proximate outer edges of the first and second lids in a widening pattern.

6. A container in accordance with claim 1, wherein outer edges of the first and second lids bear indicia indicating when the openings in the first and second lids are in alignment.

7. A container in accordance with claim 1, wherein the first and second lids pivot relative to one another in parallel planes.

8. A container comprising;

a housing including a styrofoam cup having substantially fluid impermeable walls; and a cover assembly including first and second fluid impermeable lids pivotally interconnected proximate their center for pivotal movement relative to one another, the cover assembly further including a gasket disposed between the first and second lids, the first and second lids and the gasket cooperating with each other to provide a substantially fluid impermeable container, the first and second lids and the gasket including openings alignable with each other to provide an opening into an interior of the container upon rotation of the first and second lids relative to one another.

9. A container comprising;

a housing having substantially fluid impermeable walls; and a cover assembly including first and second fluid impermeable lids pivotally interconnected proximate their center for pivotal movement relative to one another, the cover assembly further including a gasket disposed between the first and second lids, the gasket being adhesively attached to the second lid, the first and second lids and the gasket cooperating with each other to provide a substantially fluid impermeable container, the first and second lids and the gasket including openings alignable with each other to provide an opening into an interior of the container upon rotation of the first and second lids relative to one another.

* * * * *